US011828538B2

(12) United States Patent
Machida

(10) Patent No.: US 11,828,538 B2
(45) Date of Patent: Nov. 28, 2023

(54) LOOP TYPE HEAT PIPE

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 15 days.

(21) Appl. No.: 17/350,386

(22) Filed: Jun. 17, 2021

(65) Prior Publication Data

US 2021/0396476 A1 Dec. 23, 2021

(30) Foreign Application Priority Data

Jun. 18, 2020 (JP) ..... 2020-105170

(51) Int. Cl.
*F28D 15/04* (2006.01)
*F28D 15/02* (2006.01)

(52) U.S. Cl.
CPC ..... *F28D 15/043* (2013.01); *F28D 15/0266* (2013.01)

(58) Field of Classification Search
CPC ..... F28D 15/0233; F28D 15/046; F28D 15/0266; F28D 15/043; H01L 23/427
See application file for complete search history.

(56) References Cited

U.S. PATENT DOCUMENTS 8,705,236 B2 * 4/2014 Uchida ..... F28D 15/046 165/104.33
2007/0006994 A1 * 1/2007 Liu ..... F28D 15/043 165/104.33
2008/0037227 A1 2/2008 Fujiwara
2009/0323276 A1 12/2009 Mongia et al.
(Continued)

FOREIGN PATENT DOCUMENTS

EP 1 531 384 5/2005
EP 3 428 565 1/2019
(Continued)

OTHER PUBLICATIONS

European Search Report dated Nov. 15, 2021, 5 pages.
(Continued)

*Primary Examiner* — Tavia Sullens
*Assistant Examiner* — Khaled Ahmed Ali Al Samiri
(74) *Attorney, Agent, or Firm* — Rankin, Hill & Clark LLP

(57) ABSTRACT

A loop type heat pipe includes: an evaporator that vaporizes working fluids; a first condenser and a second condenser that liquefy the working fluids respectively; a first liquid pipe that includes a first flow channel and connects the evaporator and the first condenser to each other; a second liquid pipe that includes a second flow channel and connects the evaporator and the second condenser to each other; and a first vapor pipe that connects the evaporator and the first condenser to each other; and a second vapor pipe that connects
(Continued)

the evaporator and the second condenser to each other. The evaporator includes: a third flow channel connected to the first liquid pipe and the first vapor pipe; a fourth flow channel connected to the second condenser and the second vapor pipe; and a partition wall that partitions the third flow channel and the fourth flow channel from each other.

1 Claim, 6 Drawing Sheets

(56) References Cited

U.S. PATENT DOCUMENTS

| | | | | |
|---|---|---|---|---|
| 2012/0132402 | A1 | 5/2012 | Aoki et al. | |
| 2018/0058767 | A1 | 3/2018 | Machida et al. | |
| 2019/0090385 | A1* | 3/2019 | Machida | H01L 23/3736 |
| 2019/0242652 | A1 | 8/2019 | Machida | |
| 2020/0025463 | A1 | 1/2020 | Kurashima | |
| 2020/0064077 | A1 | 2/2020 | Machida | |
| 2020/0292243 | A1* | 9/2020 | Liu | F28D 15/0233 |

FOREIGN PATENT DOCUMENTS

| | | |
|---|---|---|
| EP | 3 460 375 | 3/2019 |
| JP | S49-40052 U | 4/1974 |
| JP | 2006-261472 | 9/2006 |
| JP | 6291000 | 2/2018 |
| JP | 6400240 | 9/2018 |
| JP | 2020-34185 A | 3/2020 |

OTHER PUBLICATIONS

Japanese Office Action dated Sep. 5, 2023 in corresponding Japanese application No. 2020-105170; English translation included (10 pages).

* cited by examiner

LOOP TYPE HEAT PIPE

This application claims priority from Japanese Patent Applications No. 2020-105170, filed on Jun. 18, 2020, the entire contents of which are herein incorporated by reference.

BACKGROUND

Technical Field

The present disclosure relates to a loop type heat pipe.

Background Art

Heat pipes have been known as devices each of which cools a heating component such as a CPU (Central Processing Unit) mounted on an electronic appliance. The heat pipes are devices each of which transports heat using change of a phase of a working fluid.

A loop type heat pipe has been mentioned as an example of such a heat pipe. The loop type heat pipe includes an evaporator vaporizing a working fluid by heat of a heating component, and a condenser cooling and liquefying the vaporized working fluid. In the loop type heat pipe, the evaporator and the condenser are connected to each other by a liquid pipe and a vapor pipe which form a loop-like flow channel. In the loop type heat pipe, the working fluid flows through the loop-like flow channel in one direction.

A porous body is provided in the evaporator or the liquid pipe of the loop type heat pipe. The working fluid inside the liquid pipe is guided to the evaporator by capillary force generated in the porous body so that vapor is restrained from flowing backward from the evaporator into the liquid pipe. A large number of pores are formed in the porous body. The pores are formed so that bottomed pores formed on one face side of each metal layer partially communicate with bottomed pores formed on the other face side of the metal layer (e.g. see Japanese Patent Nos. 6291000 and 6400240).

In recent years, an amount of heat generation in the heating component increases in accordance with an improvement of a signal processing speed or the like. By the background-art loop type heat pipe, it is difficult to sufficiently dissipate the heat.

SUMMARY

The present disclosure provides a loop type heat pipe that can dissipate a larger amount of heat to the outside.

Certain embodiments provide a loop type heat pipe.

The loop type heat pipe comprises:

an evaporator that vaporizes working fluids;

a first condenser and a second condenser that liquefy the working fluids respectively;

a first liquid pipe that includes a first flow channel and connects the evaporator and the first condenser to each other;

a second liquid pipe that includes a second flow channel and connects the evaporator and the second condenser to each other;

a first vapor pipe that connects the evaporator and the first condenser to each other; and a second vapor pipe that connects the evaporator and the second condenser to each other.

The evaporator comprises:

a third flow channel that is connected to the first liquid pipe and the first vapor pipe;

a fourth flow channel that is connected to the second condenser and the second vapor pipe; and a partition wall that partitions the third flow channel and the fourth flow channel from each other.

The first flow channel is partitioned from the second flow channel and the fourth flow channel and communicates with the third flow channel.

The second flow channel is partitioned from the first flow channel and the third flow channel and communicates with the fourth flow channel.

DETAILED DESCRIPTION

Figure 1:
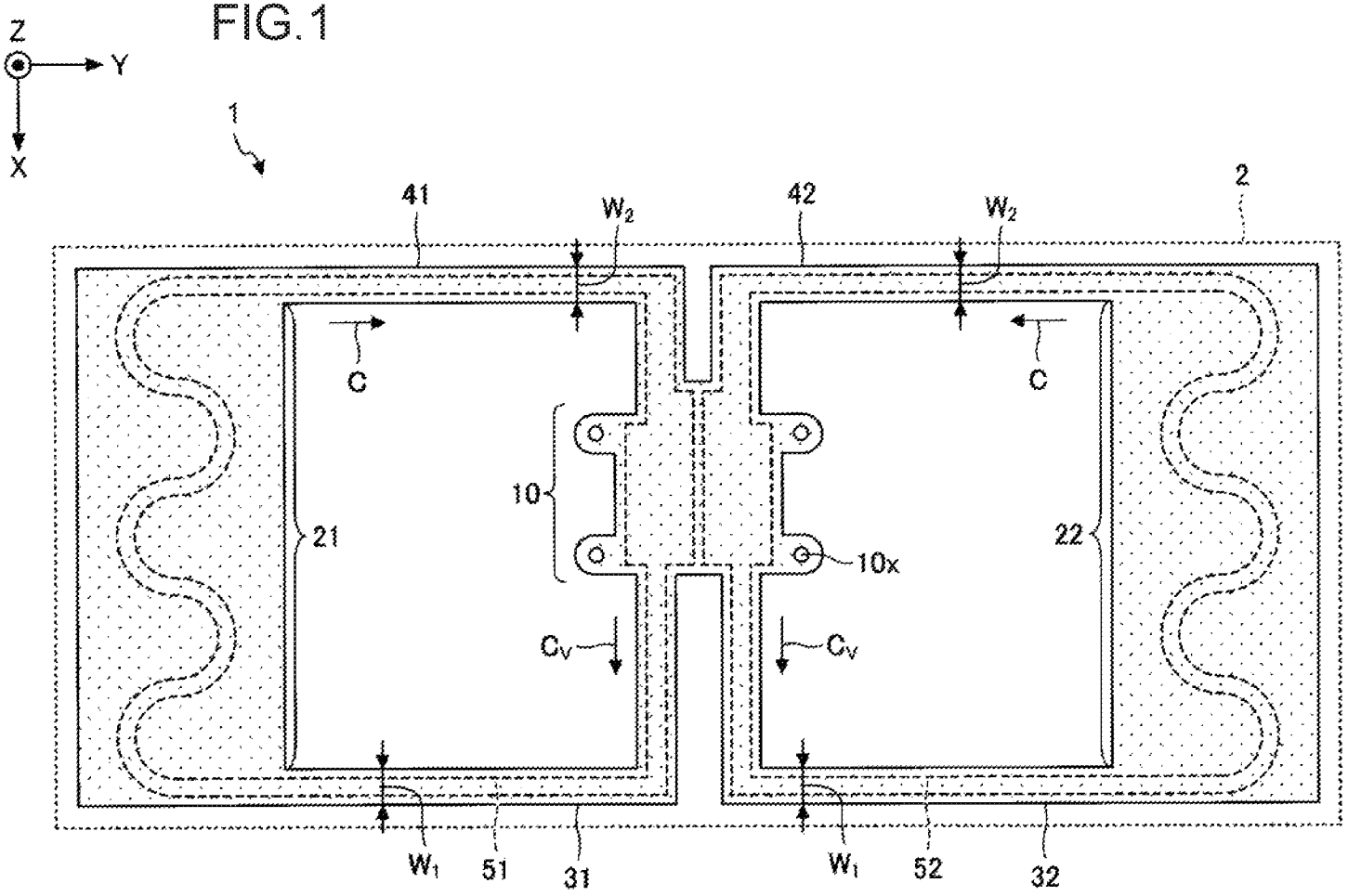
FIG. 1 is a planar schematic view illustrating a loop type heat pipe according to a first embodiment.

Embodiments of the present disclosure will be described below with reference to the drawings. Incidentally, like constituent portions will be referred to by like signs correspondingly and respectively in the drawings, and duplicate description of the constituent portions may be omitted.

First Embodiment

[Structure of Loop Type Heat Pipe According to First Embodiment]

First, a structure of a loop type heat pipe according to a first embodiment will be described. FIG. 1 is a planar schematic view illustrating the loop type heat pipe 1 according to the first embodiment.

With reference to FIG. 1, the loop type heat pipe 1 includes an evaporator 10, a first condenser 21, a second condenser 22, a first vapor pipe 31, a second vapor pipe 32, a first liquid pipe 41, and a second liquid pipe 42. The loop type heat pipe 1 can be, for example, received in a mobile type electronic appliance 2 such as a smartphone or a tablet terminal.

In the loop type heat pipe 1, the evaporator 10 has a function of vaporizing working fluids C to generate vapors Cv. Each of the first condenser 21 and the second condenser 22 has a function of liquefying the vapor Cv of the working fluid C. The first liquid pipe 41 is connected to the first condenser 21. The second liquid pipe 42 is connected to the second condenser 22. The evaporator 10 and the first condenser 21 are connected to each other by the first vapor pipe 31 and the first liquid pipe 41. The evaporator 10 and the second condenser 22 are connected to each other by the second vapor pipe 32 and the second liquid pipe 42.

Figure 2:
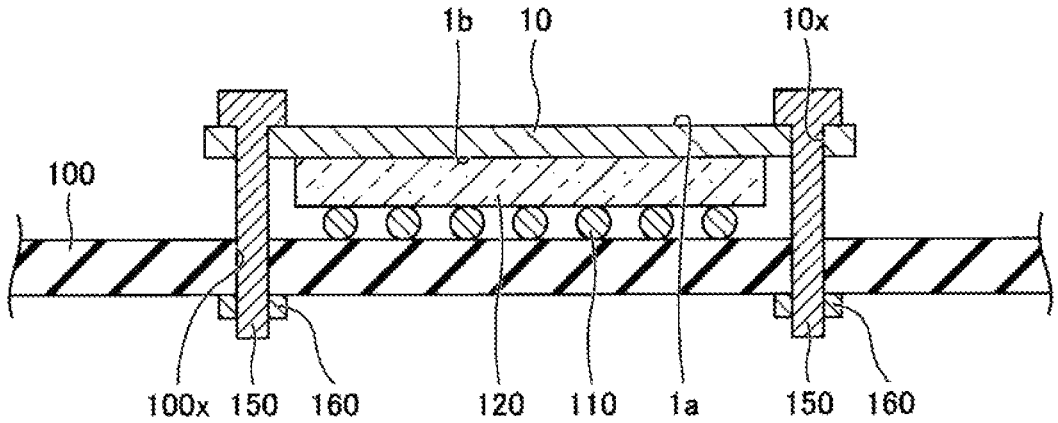
FIG. 2 is a sectional view of an evaporator and its vicinity in the loop type heat pipe according to the first embodiment.
Figure 2:
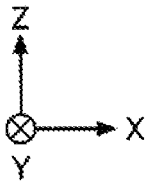

FIG. 2 is a sectional view of the evaporator and its vicinity in the loop type heat pipe according to the first embodiment. As shown in FIG. 1 and FIG. 2, for example, four through holes 10*x* are formed in the evaporator 10. Bolts 150 are inserted into the through holes 10*x* formed in the evaporator 10 and through holes 100*x* formed in a circuit board 100 respectively. Then, the bolts 150 are fastened by nuts 160 from a lower face side of the circuit board 100. In this manner, the evaporator 10 and the circuit board 100 are fixed to each other. The evaporator 10, the first condenser 21, the second condenser 22, the first vapor pipe 31, the second vapor pipe 32, the first liquid pipe 41 and the second liquid pipe 42 have an upper face 1*a*, and a lower face 1*b* arranged on an opposite side to the upper face 1*a*.

For example, a heating component 120 such as a CPU is mounted on the circuit board 100 by bumps 110 so that an upper face of the heating component 120 closely contacts the lower face 1*b* of the evaporator 10. The working fluids C inside the evaporator 10 are vaporized by heat generated by the heating component 120 so that the vapors Cv are generated.

As shown in FIG. 1, one of the vapors Cv generated by the evaporator 10 is guided to the first condenser 21 through the first vapor pipe 31 to be liquefied in the first condenser 21, and the other vapor Cv generated by, the evaporator 10 is guided to the second condenser 22 through the second vapor pipe 32 to be liquefied in the second condenser 22. Thus, the heat generated by the heating component 120 moves to the first condenser 21 and the second condenser 22 so that an increase in temperature of the heating component 120 can be suppressed. The working fluid C liquefied by the first condenser 21 is guided to the evaporator 10 through the first liquid pipe 41, and the working fluid C liquefied by the second condenser 22 is guided to the evaporator 10 through the second liquid pipe 42. A width W1 of each of the first vapor pipe 31 and the second vapor pipe 32 can be, for example, set at about 8 mm. A width W2 of each of the first liquid pipe 41 and the second liquid pipe 42 can be, for example, set at about 6 mm.

Although the kind of each of the working fluids C is not limited particularly, a fluid high in vapor pressure and large in latent heat of vaporization is preferably used in order to efficiently cool the heating component 120 by the latent heat of vaporization. Ammonia, water, freon, alcohol, and acetone can be listed as examples of such a fluid.

The evaporator 10, the first condenser 21, the second condenser 22, the first vapor pipe 31, the second vapor pipe 32, the first liquid pipe 41 and the second liquid pipe 42 can be formed by a structure in which, for example, a plurality of metal layers are stacked. As will be described later, the evaporator 10, the first condenser 21, the second condenser 22, the first vapor pipe 31, the second vapor pipe 32, the first liquid pipe 41, and the second liquid pipe 42 have a structure in which six metal layers 61 to 66 are stacked (see FIGS. 4A and 4B and FIG. 5).

Each of the metal layers 61 to 66 is, for example, a copper layer excellent in thermal conductivity. The metal layers 61 to 66 are directly bonded to one another by solid phase bonding etc. A thickness of each of the metal layers 61 to 66 can be, for example, set in a range of about 50 μm to 200 μm. Incidentally, the metal layer 61 to 66 is not limited to the copper layer, but may be formed from a stainless steel layer, an aluminum layer, a magnesium alloy layer, or the like. The number of the stacked metal layers is not limited. Alternatively, at most five metal layers or at least seven metal layers may be stacked.

Here, the solid phase bonding is a method in which subjects to be bonded are heated not to be melted but to be softened while keeping their solid phases (solid) states, and further plastically deformed by pressure to be bonded to one another. All materials of the metal layers 61 to 66 are preferably set as the same material so that adjacent ones of the metal layers can be excellently bonded by the solid phase bonding.

Figure 4A:
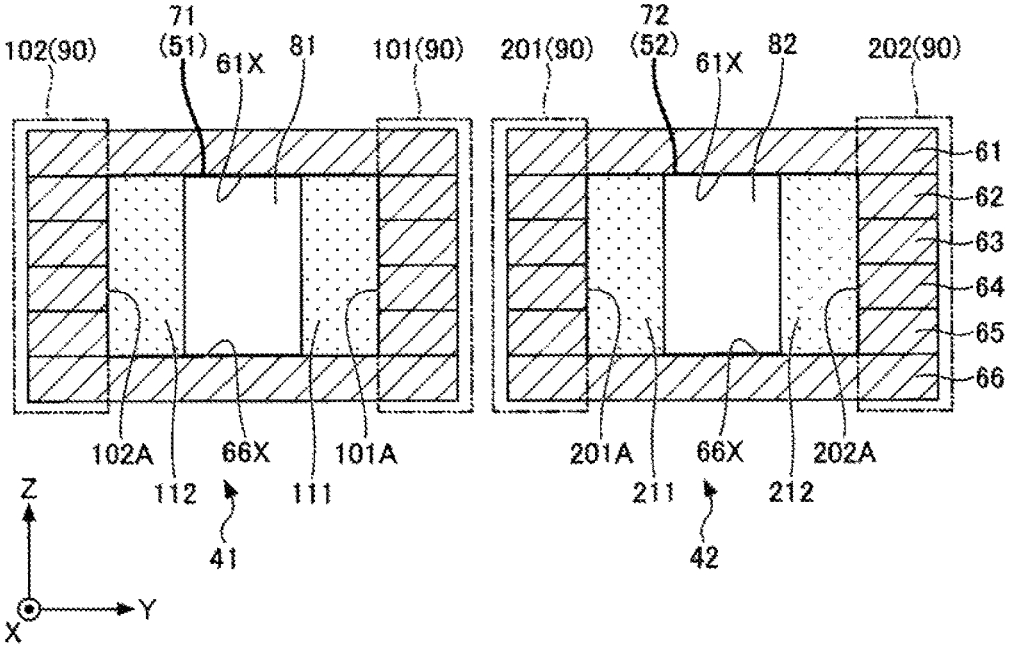
FIGS. 4A and 4B are sectional views illustrating the liquid pipes in the loop type heat pipe according to the first embodiment.
Figure 4B:
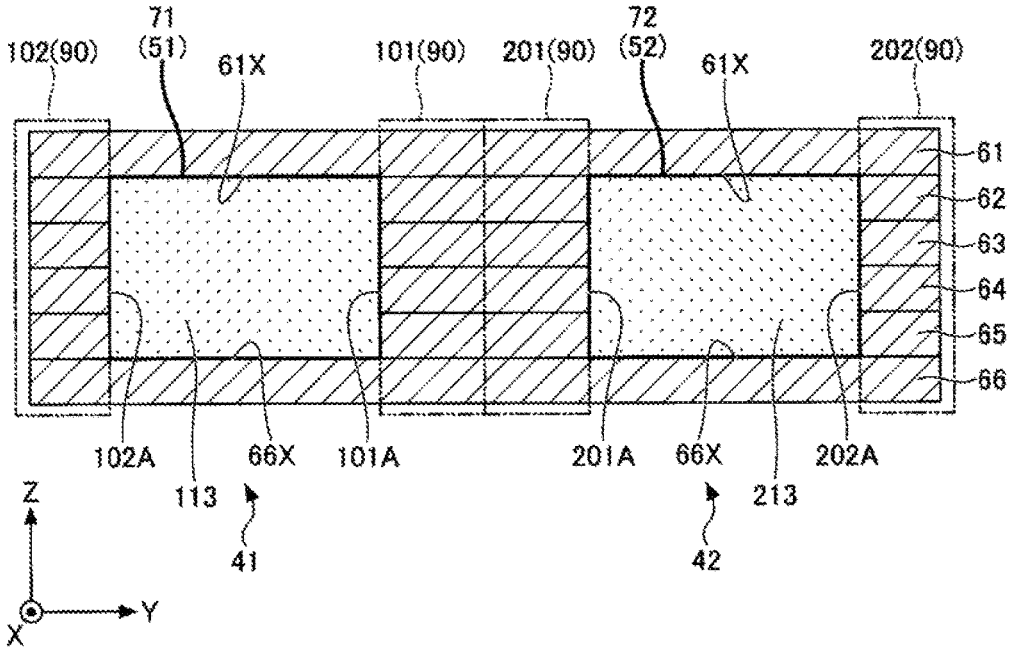
Figure 5:
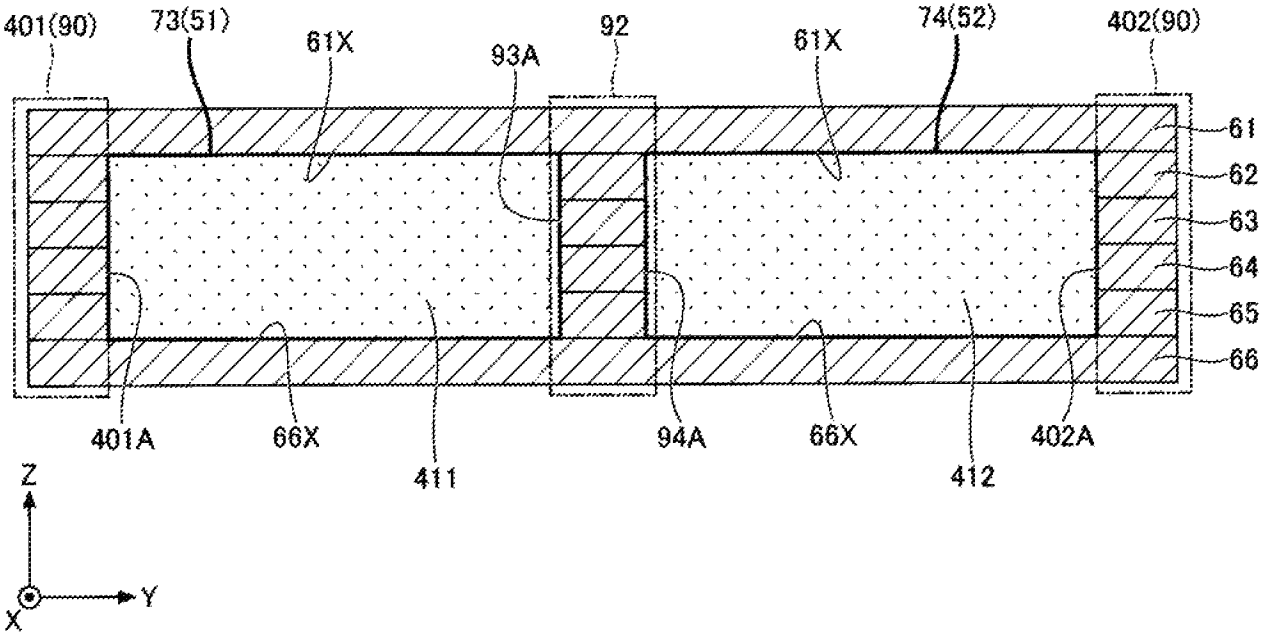
FIG. 5 is a sectional view illustrating the evaporator in the loop type heat pipe according to the first embodiment.

As shown in FIGS. 4A and 4B and FIG. 5, each of the evaporator 10, the first condenser 21, the second condenser 22, the first vapor pipe 31, the second vapor pipe 32, the first liquid pipe 41, and the second liquid pipe 42 has pipe walls 90 in its opposite end portions vertical to two directions, i.e. a direction in which the working fluid C or the vapor Cv flows and a direction in which the metal layers 61 to 66 are stacked. Each of the pipe walls 90 has a configuration in which all the metal layers 61 to 66 are stacked.

As shown in FIG. 1, a loop-like flow channel 51 is formed in the evaporator 10, the first vapor pipe 31, the first condenser 21, and the first liquid pipe 41, and a loop-like flow channel 52 is formed in the evaporator 10, the second vapor pipe 32, the second condenser 22, and the second liquid pipe 42. For example, each of the flow channel 51 and the flow channel 52 is surrounded by two inner wall faces of the two pipe walls 90, a lower face of the metal layer 61 and an upper face of the metal layer 66. The working fluids C or the vapors Cv flow through the flow channels 51 and 52. As will be described later, a porous body is provided in a portion of each of the flow channel 51 and the flow channel 52 while the remaining portion of the flow channel 51, 52 is formed as a space.

Figure 3:
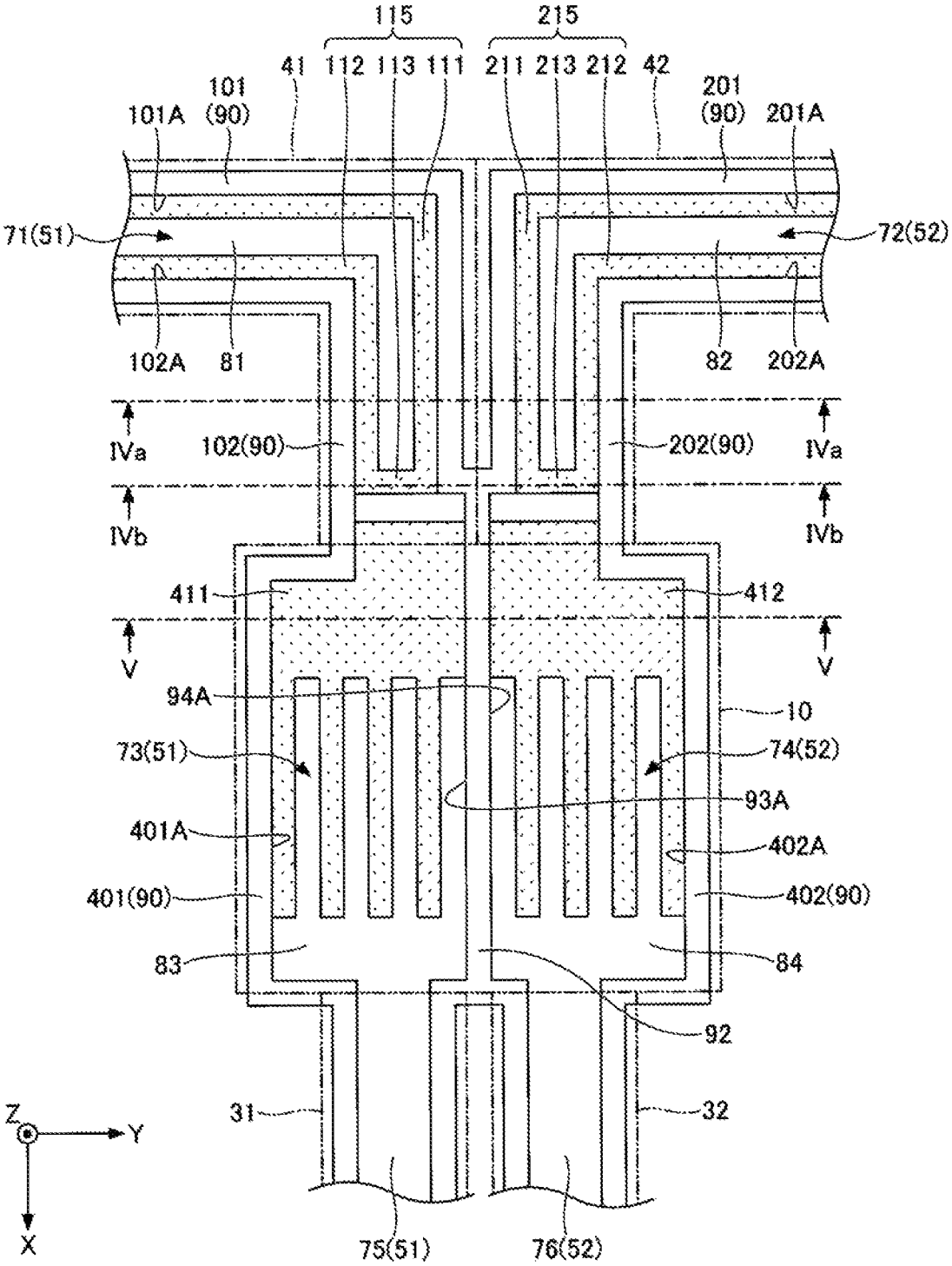
FIG. 3 is a planar schematic view showing the evaporator, liquid pipes and vapor pipes in the loop type heat pipe according to the first embodiment.

Here, the structure of the evaporator 10, the first liquid pipe 41 and the second liquid pipe 42 will be described. FIG. 3 is a planar schematic view showing the evaporator 10, the first liquid pipe 41, the second liquid pipe 42, the first vapor pipe 31, and the second vapor pipe 32 in the loop type heat pipe according to the first embodiment. FIGS. 4A and 4B are sectional views illustrating the first liquid pipe 41 and the second liquid pipe 42 in the loop type heat pipe according to the first embodiment. FIG. 5 is a sectional view illustrating the evaporator 10 in the loop type heat pipe according to the first embodiment. In FIG. 3, illustration of the outermost metal layer (the metal layer 61 shown in FIGS. 4A and 4B and FIG. 5) is omitted. FIG. 4A is a sectional view taken along a line IVa-IVa in FIG. 3. FIG. 4B is a sectional view taken along a line IVb-IVb in FIG. 3. FIG. 5 is a sectional view taken along a line V-V in FIG. 3. In FIGS. 3 to 5, the direction where the metal layers 61 to 66 are stacked is referred to as Z direction, an arbitrary direction in a plane vertical to the Z direction is referred to as X direction, and a direction orthogonal to the X direction in the plane is referred to as Y direction (so are directions in the other drawings). In addition, the plan view in the present disclosure means a plan view from the Z direction.

As shown in FIG. 3 and FIGS. 4A and 4B, the first liquid pipe 41 is provided with a first flow channel 71. The first flow channel 71 is a portion of the flow channel 51. The first liquid pipe 41 has pipe walls 101 and 102. The pipe walls 101 and 102 are portions of the pipe walls 90. The first flow channel 71 is surrounded by an inner wall face 101A of the pipe wall 101, an inner wall face 102A of the pipe wall 102, the lower face 61X of the metal layer 61, and the upper face 66X of the metal layer 66. For example, the first liquid pipe 41 holds a third porous body 115 inside the first flow channel 71. The third porous body 115 is provided with porous bodies 111, 112 and 113. Each of the porous bodies 111, 112, and 113 includes, for example, a plurality of pores (not shown) formed in the metal layers 62 to 65.

The porous body 111 (an example of a third outer side porous body) is provided to contact the inner wall face 101A of the pipe wall 101. The porous body 112 (an example of a third inner side porous body) is provided to contact the inner wall face 102A of the pipe wall 102. For example, the porous body 111 is formed integrally with the pipe wall 101, and the porous body 112 is formed integrally with the pipe wall 102. A space 81 through which the working fluid C flows is formed between the porous body 111 and the porous body 112. The space 81 is surrounded by faces of the porous bodies 111 and 112 opposed to each other, the lower face 61X of the metal layer 61, and the upper face 66X of the metal layer 66.

Each of the porous bodies 111 and 112 is provided with an evaporator 10 side end portion and a first condenser 21 side end portion. The porous body 113 (an example of a third connecting porous body) is continuous to the evaporator 10 side end portions of the porous bodies 111 and 112 to connect the porous bodies 111 and 112 to each other. The porous body 113 is, for example, embedded in the first liquid pipe 41 between the pipe wall 101 and the pipe wall 102 in one section (e.g. a section shown in FIG. 4B) vertical to the X direction. That is, an evaporator 10 side end portion of the space 81 is closed by the porous body 113. The porous body 113 is provided to contact the inner wall face 101A of the pipe wall 101, the inner wall face 102A of the pipe wall 102, the lower face 61X of the metal layer 61, and the upper face 66X of the metal layer 66. For example, the porous body 113 is formed integrally with the pipe walls 101 and 102.

As shown in FIG. 3 and FIGS. 4A and 4B, the second liquid pipe 42 is provided with a second flow channel 72. The second flow channel 72 is a portion of the flow channel 52. The second liquid pipe 42 has pipe walls 201 and 202. The pipe walls 201 and 202 are portions of the pipe walls 90. The second flow channel 72 is surrounded by an inner wall face 201A of the pipe wall 201, an inner wall face 202A of the pipe wall 202, the lower face 61X of the metal layer 61, and the upper face 66X of the metal layer 66. For example, the second liquid pipe 42 holds a fourth porous body 215 inside the second flow channel 72. The fourth porous body 215 is provided with porous bodies 211, 212 and 213. Each of the porous bodies 211, 212, and 213 includes, for example, a plurality of pores (not shown) formed in the metal layers 62 to 65.

The porous body 211 (an example of a fourth outer side porous body) is provided to contact the inner wall face 201A of the pipe wall 201. The porous body 212 (an example of a fourth inner side porous body) is provided to contact the inner wall face 202A of the pipe wall 202. For example, the porous body 211 is formed integrally with the pipe wall 201, and the porous body 212 is formed integrally with the pipe wall 202. A space 82 through which the working fluid C flows is formed between the porous body 211 and the porous body 212. The space 82 is surrounded by faces of the porous bodies 211 and 212 opposed to each other, the lower face 61X of the metal layer 61, and the upper face 66X of the metal layer 66.

Each of the porous bodies 211 and 212 is provided with an evaporator 10 side end portion and a second condenser 22 side end portion. The porous body 213 (an example of a fourth connecting porous body) is continuous to the evaporator 10 side end portions of the porous bodies 211 and 212 to connect the porous bodies 211 and 212 to each other. The porous body 213 is, for example, embedded in the second liquid pipe 42 between the pipe wall 201 and the pipe wall 202 in one section (e.g. a section shown in FIG. 4B) vertical to the X direction. That is, an evaporator 10 side end portion of the space 82 is closed by the porous body 213. The porous body 213 is provided to contact the inner wall face 201A of the pipe wall 201, the inner wall face 202A of the pipe wall 202, the lower face 61X of the metal layer 61 and the upper face 66X of the metal layer 66. For example, the porous body 213 is formed integrally with the pipe walls 201 and 202.

As shown in FIG. 3 and FIGS. 4A and 4B, the pipe wall 101 is positioned on an outer side of the loop-like flow channel 51, the pipe wall 102 is positioned on an inner side of the loop-like flow channel 51, the pipe wall 201 is positioned on an outer side of the loop-like flow channel 52, and the pipe wall 202 is positioned on an inner side of the loop-like flow channel 52. For example, the first liquid pipe 41 and the second liquid pipe 42 extend in the X direction in the vicinity of the evaporator 10. The pipe wall 101 and the pipe wall 201 are adjacent to each other in the Y direction at a site where the first liquid pipe 41 and the second liquid pipe 42 extend in the X direction. In addition, the pipe walls 101 and 201 are connected to each other in front of a boundary between the evaporator 10 and the first and second liquid pipes 41 and 42. That is, the pipe walls 101 and 201 are continuous to each other. The pipe wall 101 is an example of a first pipe wall, the pipe wall 102 is an example of a second pipe wall, the pipe wall 201 is an example of a third pipe wall, and the pipe wall 202 is an example of a fourth pipe wall.

Thus, the third porous body 115 (the porous bodies 111 to 113) is provided in the first liquid pipe 41, and the fourth porous body 215 (the porous bodies 211 to 213) is provided in the second liquid pipe 42. The working fluids C in a liquid phase inside the first liquid pipe 41 and the second liquid pipe 42 are guided to the evaporator 10 due to capillary forces generated in these porous bodies.

As a result, even if the vapors Cv flow backward into the first liquid pipe 41 and the second liquid pipe 42 due to heat leak etc. from the evaporator 10, the vapors Cv can be pressed back by the capillary forces acting on the working fluids C in the liquid phase from the porous bodies inside the first liquid pipe 41 and the second liquid pipe 42 so that the backflow of the vapors Cv can be prevented.

In addition, as shown in FIG. 3 and FIG. 5, the evaporator 10 has a third flow channel 73, a fourth flow channel 74, and a partition wall 92 partitioning the third flow channel 73 and the fourth flow channel 74 from each other. The third flow channel 73 is connected to the first liquid pipe 41 and the first vapor pipe 31, and the fourth flow channel 74 is connected to the second liquid pipe 42 and the second vapor pipe 32. The third flow channel 73 is a portion of the flow channel 51, and the fourth flow channel 74 is a portion of the flow channel 52.

The evaporator 10 has pipe walls 401 and 402. The pipe wall 401 is continuous to the pipe wall 102. The pipe wall 402 is continuous to the pipe wall 202. The pipe walls 401 and 402 are portions of the pipe walls 90. One end portion of the partition wall 92 is connected to the pipe wall 90 between the first vapor pipe 31 and the second vapor pipe 32. The other end portion of the partition wall 92 is connected to the pipe wall 101 and the pipe wall 201 between the pipe wall 102 of the first liquid pipe 41 and the pipe wall 202 of the second liquid pipe 42. The partition wall 92 has a side wall face 93A on the third flow channel 73 side, and a side wall face 94A on the fourth flow channel 74 side. The third flow channel 73 is surrounded by an inner wall face 401A of the pipe wall 401, the side wall face 93A of the partition wall 92, the lower face 61X of the metal layer 61, and the upper face 66X of the metal layer 66. The fourth flow channel 74 is surrounded by an inner wall face 402A of the pipe wall 402, the side wall face 94A of the partition wall 92, the lower face 61X of the metal layer 61, and the upper face 66X of the metal layer 66. Thus, the partition wall 92 is continuous to the pipe wall 90 between the first vapor pipe 31 and the second vapor pipe 32, and to the pipe walls 101 and 201. The first flow channel 71 of the first liquid pipe 41 is partitioned from the second flow channel 72 and the fourth flow channel 74. The second flow channel 72 of the second liquid pipe 42 is partitioned from the first flow channel 71 and the third flow channel 73.

The evaporator 10 holds, for example, a first porous body 411 inside the third flow channel 73, and a second porous body 412 inside the fourth flow channel 74. The first porous body 411 is shaped like comb teeth in plan view. The second porous body 412 is also shaped like comb teeth in plan view. The first porous body 411 is disposed separately from the third porous body 115. The second porous body 412 is disposed separately from the fourth porous body 215. The first porous body 411 may be provided to contact the inner wall face 401A of the pipe wall 401, the side wall face 93A of the partition wall 92, the lower face 61X of the metal layer 61 and the upper face 66X of the metal layer 66. The second porous body 412 may be provided to contact the inner wall face 402A of the pipe wall 402, the side wall face 94A of the partition wall 92, the lower face 61X of the metal layer 61, and the upper face 66X of the metal layer 66. For example, the first porous body 411 is formed integrally with the pipe wall 401 and the partition wall 92, and the second porous body 412 is formed integrally with the pipe wall 402 and the partition wall 92. Each of the first porous body 411 and the second porous body 412 includes a plurality of pores not shown) formed in the metal layers 62 to 65.

A space 83 is formed inside the third flow channel 73 in an area in which the first porous body 411 is not provided. The space 83 is linked to a fifth flow channel 75 of the first vapor pipe 31. The first porous body 411 and the space 83 are disposed between the first liquid pipe 41 and the first vapor pipe 31. A space 84 is formed inside the fourth flow channel 74 in an area in which the second porous body 412 is not provided. The space 84 is connected to a sixth flow channel 76 of the second vapor pipe 32. The second porous body 412 and the space 84 are disposed between the second liquid pipe 42 and the second vapor pipe 32. The vapors Cv of the working fluids C flow through the spaces 83 and 84. The fifth flow channel 75 is a portion of the flow channel 51, and the sixth flow channel 76 is a portion of the flow channel 52.

The working fluid C is guided to the evaporator 10 from the third porous body 115 side to permeate the first porous body 411. The working fluid C permeating the first porous body 411 inside the evaporator 10 is vaporized by the heat generated by the heating component 120 so that the vapor Cv is generated. The vapor Cv generated thus passes through the space 83 inside the evaporator 10 to flow into the first vapor pipe 31. In addition, the working fluid C is guided to the evaporator 10 from the fourth porous body 215 side to permeate the second porous body 412. The working fluid C permeating the second porous body 412 inside the evaporator 10 is vaporized by the heat generated by the heating component 120 so that the vapor Cv is generated. The vapor Cv generated thus passes through the space 84 inside the evaporator 10 to flow into the second vapor pipe 32. Incidentally, the number of protrusive portions (comb teeth) of each of the first porous body 411 and the second porous body 412 is set as four by way of example in FIG. 3. The number of the protrusive portions (comb teeth) can be determined suitably. When a contact area between the protrusive portions and the space 83, 84 increases, the working fluid C is vaporized more easily so that pressure loss is decreased more easily. In the first embodiment, a volume of the third flow channel 73 is about the same as a volume of the fourth flow channel 74, and the contact area between the space 83 and the first porous body 411 is about the same as the contact area between the space 84 and the second porous body 412.

Incidentally, an injection port (not shown) for injecting the working fluid C is formed in one or each of the first liquid pipe 41 and the second liquid pipe 42. The injection port is used for injecting the working fluid C and closed after the working fluid C is injected. Therefore, the inside of the loop type heat pipe 1 is kept airtight.

In the first embodiment, the first condenser 21 and the second condenser 22 are provided for one evaporator 10. Accordingly, a heat dissipation area is enlarged so that heat given to the evaporator 10 is more easily dissipated to the outside. In addition, the third flow channel 73 and the fourth flow channel 74 partitioned from each other by the partition wall 92 are included in the evaporator 10. The third flow channel 73 is connected to the first liquid pipe 41 and the first vapor pipe 31. The fourth flow channel 74 is connected to the second liquid pipe 42 and the second vapor pipe 32. Accordingly, the working fluids C stably flow through the flow channel 51 and the flow channel 52 respectively. Further, the first flow channel 71 is partitioned from the second flow channel 72 and the fourth flow channel 74. The second flow channel 72 is partitioned from the first flow channel 71 and the third flow channel 73. Accordingly, even when there is a difference in easiness of the heat dissipation between the first condenser 21 and the second condenser 22, the working fluids C in the liquid phase can be continuously supplied to the evaporator 10 stably and independently of each other. That is, according to the first embodiment, it is possible to dissipate the heat with excellent efficiency while suppressing a dry-out state.

Incidentally, the porous bodies may be also provided in portions of the first condenser 21 and the second condenser 22, and may be also provided in portions of the first vapor pipe 31 and the second vapor pipe 32.

Second Embodiment

Figure 6:
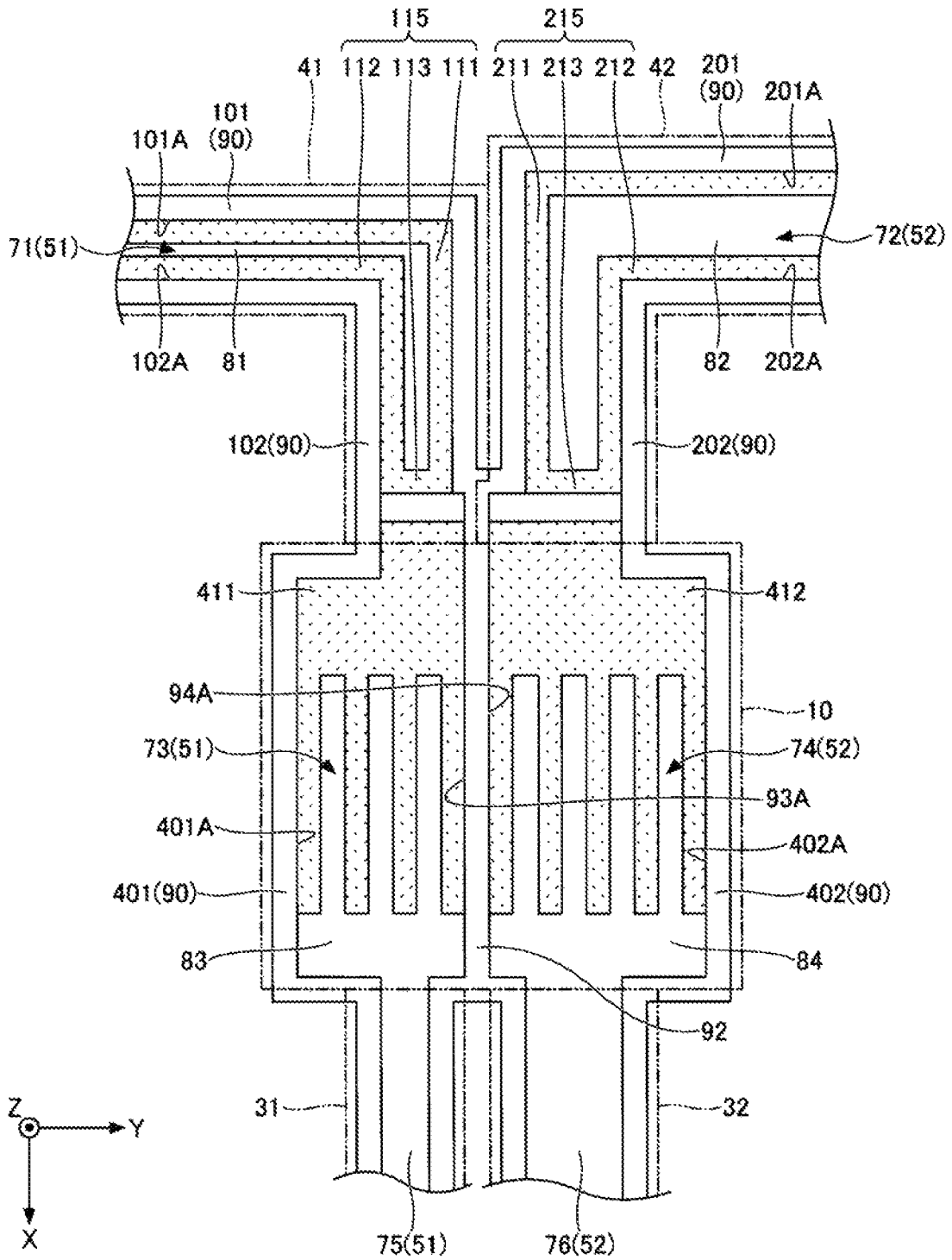
FIG. 6 is a planar schematic view showing an evaporator, liquid pipes and vapor pipes in a loop type heat pipe according to a second embodiment.

A configuration of an evaporator 10 according to a second embodiment is mainly different from that according to the first embodiment. Description about the same constituent portions as those which have been described in the embodiment may be omitted in the second embodiment. FIG. 6 is a planar schematic view showing the evaporator 10, a first liquid pipe 41, a second liquid pipe 42, a first vapor pipe 31 and a second vapor pipe 32 in a loop type heat pipe according to the second embodiment. In FIG. 6, an outermost metal layer (a metal layer 61 shown in FIGS. 4A and 4B and FIG. 5) is omitted.

In the second embodiment, a second condenser 22 is disposed in an environment in which the second condenser 22 more easily dissipates heat than a first condenser 21. For example, the second condenser 22 is disposed in a larger area than that for the first condenser 21, or a cooling fan is disposed in the vicinity of the second condenser 22. Overall, a sectional area of a sixth flow channel 76 is larger than a sectional area of a fifth flow channel 75. For example, as shown in FIG. 6, the sectional area and a width of the sixth flow channel 76 in a boundary with a fourth flow channel 74 are larger than the sectional area and a width of the fifth flow channel 75 in a boundary with a third flow channel 73. In addition, a volume of the fourth flow channel 74 is larger than a volume of the third flow channel 73, and a contact area between a space 84 and a second porous body 412 is larger than a contact area between a space 83 and a first porous body 411. For example, a distance between an inner wall face 402A and a side wall face 94A is larger than a distance between an inner wall face 401A and a side wall face 93A. In addition, a sectional area of a second flow channel 72 in a boundary with the fourth flow channel 74 is larger than a sectional area of a first flow channel 71 in a boundary with the third flow channel 73.

The remaining configuration is similar to or the same as that in the first embodiment.

Similar effects to or the same effects as those obtained by the first embodiment can be also obtained by the second embodiment. In addition, the second embodiment has a configuration in which the second condenser 22 is disposed in the environment where the second condenser 22 more easily dissipates heat than the first condenser 21 so that a larger amount of a working fluid C is allowed to flow through a flow channel 52 than through a flow channel 51. Accordingly, it is possible to obtain more excellent heat dissipation properties.

Incidentally, the number of the condensers is not limited to two. Three or more condensers may be connected to the evaporator through vapor pipes and liquid pipes.

Although the preferred embodiments have been described above in detail, the present disclosure does not have to be limited to the aforementioned embodiments but various modifications and replacements can be made on the aforementioned embodiments without departing from the scope described in claims.

What is claimed is:

1. A loop type heat pipe comprising:

an evaporator that vaporizes working fluids;

a first condenser and a second condenser that liquefy the working fluids respectively;

a first liquid pipe that includes a first flow channel and connects the evaporator and the first condenser to each other;

a second liquid pipe that includes a second flow channel and connects the evaporator and the second condenser to each other;

a first vapor pipe that connects the evaporator and the first condenser to each other; and a second vapor pipe that connects the evaporator and the second condenser to each other, wherein the evaporator comprises:

a third flow channel that is connected to the first liquid pipe and the first vapor pipe;

a fourth flow channel that is connected to the second liquid pipe and the second vapor pipe;

a partition wall that partitions the third flow channel and the fourth flow channel from each other;

a first porous body that is disposed in the third flow channel; and a second porous body that is disposed in the fourth flow channel;

the first flow channel is partitioned from the second flow channel and the fourth flow channel and communicates with the third flow channel;

the second flow channel is partitioned from the first flow channel and the third flow channel and communicates with the fourth flow channel;

the first liquid pipe comprises a third porous body that is separated from the first porous body;

the second liquid pipe comprises a fourth porous body that is separated from the second porous body;

the first liquid pipe comprises a first pipe wall and a second pipe wall that are opposed to each other across the first flow channel;

the second liquid pipe comprises a third pipe wall and a fourth pipe wall that are opposed to each other across the second flow channel;

the third porous body comprises:

a third outer side porous body that contacts the first pipe wall;

a third inner side porous body that contacts the second pipe wall and that is opposed to and spaced from the third outer side porous body across the first flow channel; and a third connecting porous body that spans between and connects the third outer side porous body and the third inner side porous body to each other;

the fourth porous body comprises:

a fourth outer side porous body that contacts the third pipe wall;

a fourth inner side porous body that contacts the fourth pipe wall and that is opposed to and spaced from the fourth outer side porous body across the second flow channel; and a fourth connecting porous body that spans between and connects the fourth outer side porous body and the fourth inner side porous body to each other;

the first porous body is opposed to the third connecting porous body across a gap; and the second porous body is opposed to the fourth connecting porous body across a gap.

* * * * *